US005948299A

United States Patent [19]

Scalia

[11] Patent Number: 5,948,299

[45] Date of Patent: Sep. 7, 1999

[54] PORTABLE SNOW MELTING DEVICE

[76] Inventor: Henry Scalia, 1075 East 51st St., Brooklyn, N.Y. 11234

[21] Appl. No.: 09/110,031

[22] Filed: Jul. 2, 1998

[51] Int. Cl.[6] ..... H05B 1/00

[52] U.S. Cl. ..... 219/228; 219/227; 219/533

[58] Field of Search ..... 219/227, 228, 219/221, 245, 200, 201, 533; 37/227, 229, 230, 196, 199; 15/144.4; 405/131; 165/45

[56] References Cited

U.S. PATENT DOCUMENTS

| | | | |
|---|---|---|---|
| 619,314 | 2/1899 | Jones | 219/228 |
| 1,507,764 | 9/1924 | Beeson | 219/228 |
| 1,578,178 | 3/1926 | Scoles | 219/228 |
| 2,609,316 | 9/1952 | Fichtner | 219/228 |
| 2,699,614 | 1/1955 | Welch | 219/228 |
| 3,091,790 | 6/1963 | Schroeder | 15/144.4 |
| 3,400,244 | 9/1968 | Meltzer | 219/228 |
| 3,866,257 | 2/1975 | Cansdale, Sr. | 15/144.4 |
| 3,989,925 | 11/1976 | Garner | 219/227 |
| 4,034,489 | 7/1977 | Hughes, Jr. | 37/230 |
| 4,517,757 | 5/1985 | Asada et al. | 392/385 |
| 4,528,440 | 7/1985 | Ishihara | 392/385 |
| 4,533,423 | 8/1985 | Johnson et al. | 219/227 |
| 4,967,057 | 10/1990 | Bayless | 219/213 |
| 5,140,762 | 8/1992 | Monson | 37/227 |
| 5,380,988 | 1/1995 | Dyer | 219/548 |
| 5,591,365 | 1/1997 | Shields | 219/213 |
| 5,605,418 | 2/1997 | Watanabe | 405/131 |
| 5,867,926 | 2/1999 | Schmitt | 37/227 |

FOREIGN PATENT DOCUMENTS

| | | | |
|---|---|---|---|
| 2-70810 | 3/1990 | Japan | 37/227 |
| 225016 | 12/1942 | Switzerland | 219/228 |
| 257184 | 9/1948 | Switzerland | 219/228 |
| 609400 | 2/1979 | Switzerland | 37/227 |
| 2211530 | 7/1989 | United Kingdom | 37/227 |

*Primary Examiner*—Teresa Walberg
*Assistant Examiner*—Shawntina Fugua
*Attorney, Agent, or Firm*—Goldstein & Canino

[57] ABSTRACT

A snow melter, comprising a melting assembly and a handle assembly. The melting assembly comprises a melting plate which contains an electric heating element. The melting assembly also has a top plate which is made of an insulating material, and a bottom plate which is porous or has a grating for allowing snow to contact the melting plate but prevents the user from inadvertently contacting the melting plate. The handle assembly has a proximal end having upper and lower handgrips, and a distal end which attaches to the melting assembly. The distal end is preferably attached to the melting assembly at an operating angle which is substantially ten to twenty five degrees from a normal line to the point of attachment between the handle assembly and the melting assembly. An extension cord connects the melting plate to a power source, and is preferably mounted on a spring loaded spool which is located near the distal end of the handle.

4 Claims, 2 Drawing Sheets

FIG. 1
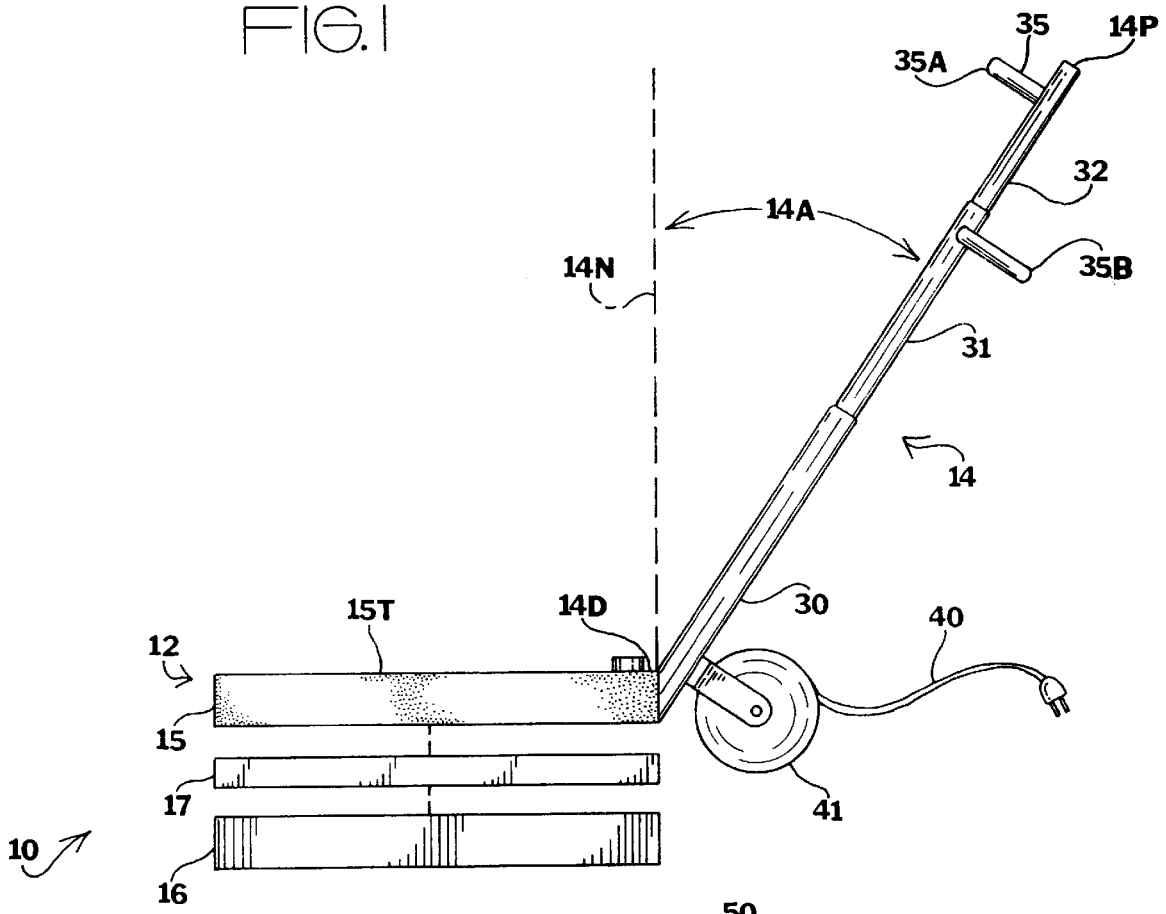
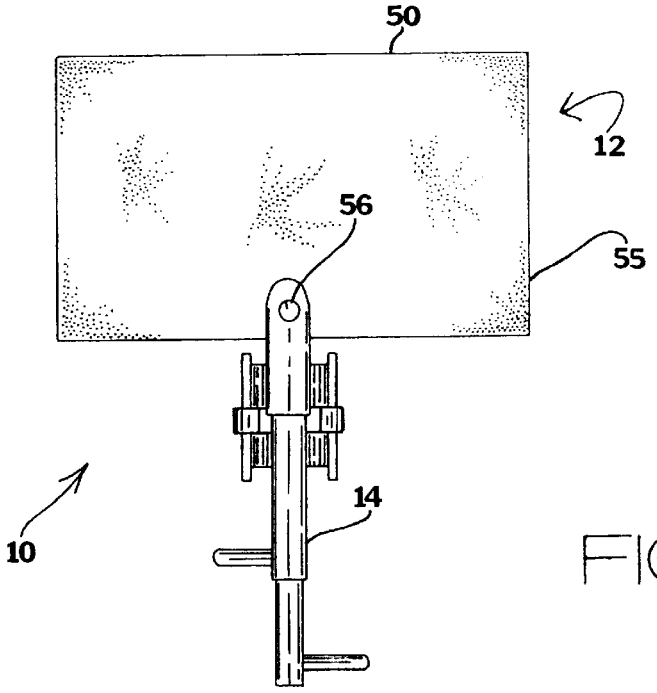
FIG. 2

PORTABLE SNOW MELTING DEVICE

BACKGROUND OF THE INVENTION

The invention relates to a portable snow melting device. More particularly, the invention relates to a device which contains a heating element, and which may be applied to the surface of snow to warm the snow and initiate melting thereof.

A snowfall may be exciting for children—who look forward to fun in the snow, but can be aggravating to adults—who anticipate hours of back-breaking snow removal work.

Snow removal on sidewalks, walkways, driveways, and patios is traditionally carried out with a shovel. The problems with using a shovel are many. First, a lot of labor is involved with repeatedly undermining the shovel beneath a pile of snow, and then physically lifting the snow away from the sidewalk. Second, the shovel cannot always remove all of the snow. On textured sidewalks and brick or cobblestone driveways, it is not possible to scrape off all snow. Third, on such textured sidewalks and driveways, it is extremely difficult to carry out shoveling at all, since the shovel continually snags upon a brick, stone, or the like. The shovel can even chip bricks and stones, creating a weathered appearance after the winter. A similar problem exists with shoveling snow from uneven or broken sidewalks and driveways.

The snow blower has been around for decades, and provides a less labor intensive snow removal solution for some people. However, the snow blowers typically employ two stroke engines, which are often difficult to start, and require long term storage of gasoline and oil. Further, they are loud and produce the odor of gasoline exhaust as they operate. Thus they are unsuitable for use in tight alleys and near buildings where the fumes could harm people living therein.

Several have proposed devices for melting snow. U.S. Pat. No. 4,967,057 to Bayless; U.S. Pat. No. 5,380,988 to Dyer; U.S. Pat. No. 5,605,418 to Watanabe; and U.S. Pat. No. 5,591,365 to Shields each disclose snow melting heated mats. These devices demonstrate that there is available technology for producing a mat which is capable of heating and melting snow. However, these devices are only suited for installation upon a walkway prior to a snowfall, so that they can then be activated following the snowfall to cause the snow to melt. However, none of these devices are suited for portable use wherein the device is brought to a location after a snowfall where snow melting is desired, to effect snow melting at that location.

While these units may be suitable for the particular purpose employed, or for general use, they would not be as suitable for the purposes of the present invention as disclosed hereafter.

SUMMARY OF THE INVENTION

It is an object of the invention to produce a snow melting device which quickly and effectively melts snow present on the ground. Accordingly an electric heating element is provided to initiate snow melting.

It is another object of the invention to provide a snow melting device which is portable so that it may be brought to a location where melting is desired, to then initiate snow melting. Accordingly, the device has a retractable extension cord which allows the device to be transported a considerable distance away from a power source to provide snow melting wherever needed.

It is another object of the invention to provide a snow melting device which is easy to use, and is configured to be comfortable to use with minimal physical exertion by the user. Accordingly a handle is provided which allows the user to maintain a comfortable posture while effecting snow melting on the ground.

The invention is a snow melter, comprising a melting assembly and a handle assembly. The melting assembly comprises a melting plate which contains an electric heating element. The melting assembly also has a top plate which is made of an insulating material, and a bottom plate which is porous or has a grating for allowing snow to contact the melting plate but prevents the user from inadvertently contacting the melting plate. The handle assembly has a proximal end having upper and lower handgrips, and a distal end which attaches to the melting assembly. The distal end is preferably attached to the melting assembly at an operating angle which is substantially ten to twenty five degrees from a normal line to the point of attachment between the handle assembly and the melting assembly. An extension cord connects the melting plate to a power source, and is preferably mounted on a spring loaded spool which is located near the distal end of the handle.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a side elevational view, illustrating the snow melting device according to the present invention.

FIG. 2 is a top plan view thereof.

DETAILED DESCRIPTION OF THE PREFERRED EMBODIMENTS

Figures 3, 4:
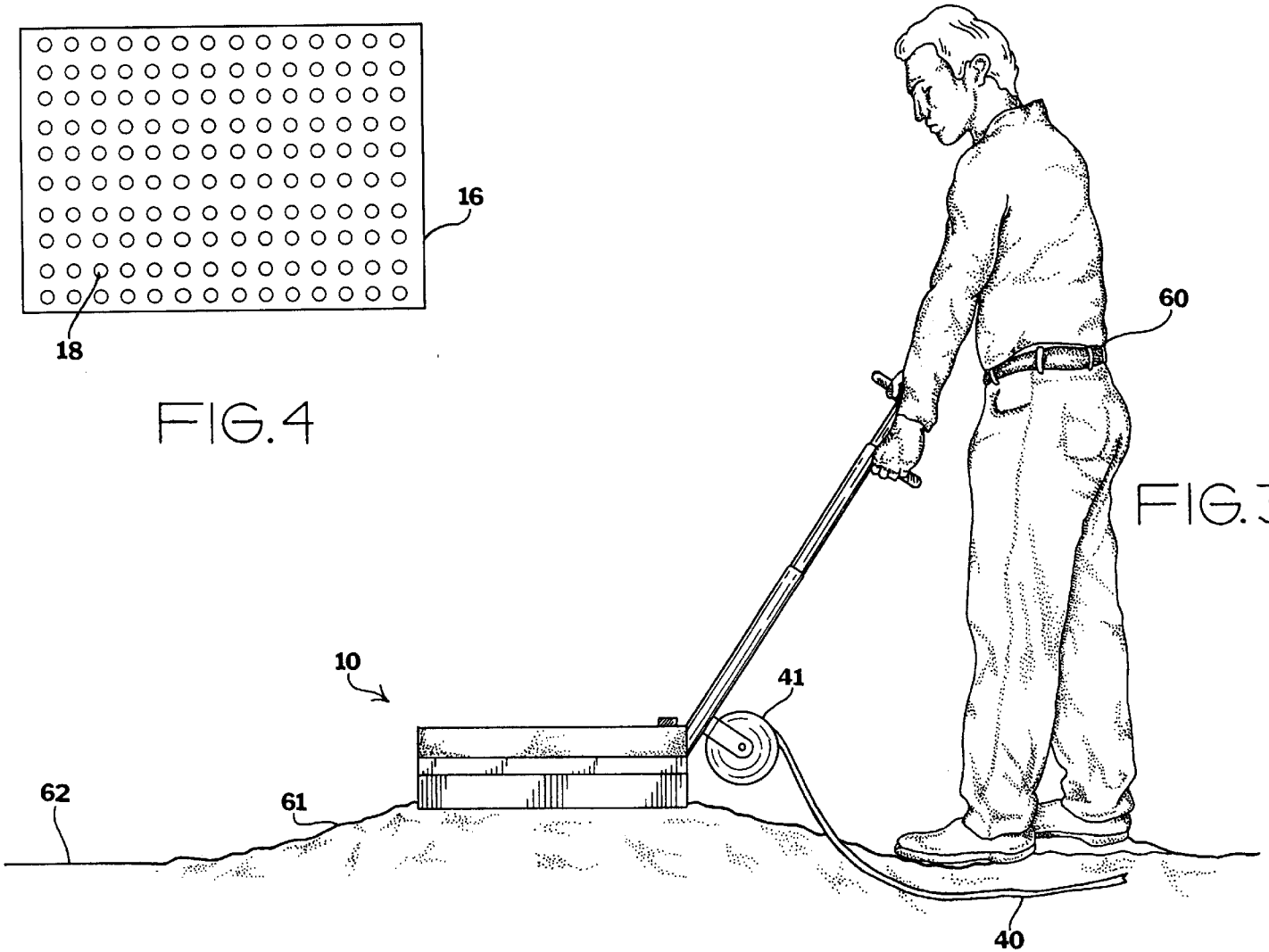
FIG. 3 is a side elevational view, illustrating the snow melting device in use.
FIG. 4 is a bottom plan view, illustrating the bottom plate.

FIG. 1 illustrates a snow melting device 10, comprising a melting assembly 12 and a handle assembly 14. The melting assembly 12 extends horizontally. The handle assembly 14 has a proximal end 14P and a distal end 14D. The melting assembly 12 is attached to the distal end 14D of the handle assembly 14. The handle may extend perpendicularly upward from the melting assembly 12. However, preferably the handle forms an operating angle 14A with respect to a normal line 14N extending to a point of connection between the melting assembly 12 and the distal end 14D of the handle 14. The operating angle 14A is preferably between ten and twenty five degrees, which is optimal to maintaining comfortable, low back strain operation.

The melting assembly 12 is a lamination of an upper plate 15, a lower plate 16, and a melting plate 17 between the upper plate 15 and lower plate 16. The melting plate 17 is an electric heating element which may be any conventional electrical heating scheme, such as a heating plate or a close packed arrangement of heating coils. The upper plate 15 has a top surface 15T, and is made of an insulating material, which is of sufficient thickness so that the top surface 15T remains cool, even after the melting plate 17 is fully heated.

The lower plate 16 is a heat plate guard, whose purpose is to prevent burning injuries resulting from inadvertent contact with the melting plate 17. FIG. 4 illustrates the lower plate 16 being porous or can be a grating with a plurality of openings 18 to allow the lower plate 16 to be placed over a snow pile until the melting plate 17 contacts the snow pile. However, the openings are intentionally too small so that they do not allow fingers to enter therethrough and inadvertently contact the heating plate.

The handle assembly 14 may comprise multiple telescoping segments, including a lower handle 30, upper handle 32, and a middle handle 31 between the upper handle 32 and lower handle 30. The lower handle 30 is present at the distal end 14D and the upper handle 32 is present at the proximal end 14P of the handle 14. A pair of hangrips 35, including an upper handgrip 35A and a lower handgrip 35B are located on the upper handle 32. The upper handgrip 35A and lower handgrip 35B extend substantially perpendicular to the upper handle 32. The upper handgrip 35A extends substantially toward the melting assembly 12. The lower handgrip 35B extends substantially away from the melting assembly 12. This opposite positioning of the handgrips 35 allows the entire snow melter 10 to be easily lifted, by creating a double lever, with a fulcrum located midway between the handgrips 35.

Power is supplied to the melting plate 17 with a power cord 40. The power cord 40 is preferably located on a spool 41 which is spring loaded to allow the power cord 40 to easily extend and retract depending on the distance to the nearest power source. The spool 41 is preferably located near the distal end 14D of the handle.

FIG. 2 is a top plan view illustrating the snow melter 10. As illustrated, the melting assembly 12 is preferably broad, having a melting assembly width 50 and a melting assembly length 55. The melting assembly width 50 exceeds the melting assembly length 55. The aim is to provide melting across a wide area, while keeping the weight of the melting assembly 12 relatively close to a user that is holding the handle 14 and operating the snow melter 10. Also seen in FIG. 2 is a power switch 56, which selectively allows a user to switch between off, and low and high heat positions.

FIG. 3 illustrates the snow melter 10 in use. A user 60 is holding the handle, and bringing the snow melter 10 into contact with a snow pile 61 which is resting upon a ground surface 62. The extension cord 40 extends from the spool 41 and connects the snow melter 10 to a power source.

In conclusion, herein is presented a snow melter which provides a melting assembly which is supported by a handle assembly. The melting assembly has a melting plate which contacts and heats snow to initiate melting thereof. An extension cord is located on a spool near the melting assembly to allow the snow melter to be used a considerable distance away from a power source.

What is claimed is:

1. A snow melting device, for use upon a ground surface comprising:

a melting assembly, extending horizontally and parallel to the ground surface and comprising a melting plate which has an electric heating element wherein the melting assembly further comprises an upper plate and a lower plate, the melting plate is located between the upper plate and lower plate, the upper plate is made of a heat insulating material, the lower plate is porous to allow the melting plate to contact snow to be melted but to prevent people from inadvertently contacting the melting plate;

a handle assembly having a proximal end and a distal end, the distal end attached to the melting assembly for selectively lifting the melting assembly from the ground, the handle assembly comprises an upper handle, a lower handle, and a middle handle, the upper handle is located at the proximal end of the handle assembly, the lower handle is located at the distal end of the handle assembly, the middle handle is located between the upper handle and lower handle;

an extension cord for attaching the melting plate to a distant power source; and a pair of grips, including an upper grip and a lower grip located on the upper handle, wherein the upper grip extends perpendicular to the upper handle and extends substantially toward the melting assembly, and the lower grip extends perpendicular to the upper handle and extends substantially away from the melting assembly.

2. The snow melting device as recited in claim 1, wherein the handle assembly is attached to the melting assembly at an operating angle which varies from normal by substantially ten to twenty five degrees.

3. The snow melting assembly as recited in claim 2, further comprising a spool mounted near the distal end of the handle assembly, for allowing convenient extension and retraction of the extension cord according to how close or far the snow melter is from the power source.

4. The snow melting assembly as recited in claim 3, wherein the upper handle, lower handle and middle handle telescope in length.

* * * * *